US009408430B2

(12) United States Patent
Guay et al.

(10) Patent No.: US 9,408,430 B2
(45) Date of Patent: Aug. 9, 2016

(54) PROTECTIVE HELMET AND SCREEN

(71) Applicant: MSA Gallet, Chatillon sur Chalaronne (FR)

(72) Inventors: Louis Guay, Chatillon sur Chalaronne (FR); Pascal Michel, Dompierre sur Chalaronne (FR)

(73) Assignee: MSA Production France, Chatillon sur Chalaronne (FR)

( * ) Notice: Subject to any disclaimer, the term of this patent is extended or adjusted under 35 U.S.C. 154(b) by 84 days.

(21) Appl. No.: 14/384,503

(22) PCT Filed: Mar. 11, 2013

(86) PCT No.: PCT/EP2013/054810
§ 371 (c)(1),
(2) Date: Sep. 11, 2014

(87) PCT Pub. No.: WO2013/135599
PCT Pub. Date: Sep. 19, 2013

(65) Prior Publication Data

US 2015/0040299 A1 Feb. 12, 2015

(30) Foreign Application Priority Data

Mar. 15, 2012 (FR) ..... 12 52315

(51) Int. Cl.
*A42B 3/22* (2006.01)
*A42B 3/04* (2006.01)

(52) U.S. Cl.
CPC . *A42B 3/221* (2013.01); *A42B 3/04* (2013.01); *A42B 3/222* (2013.01)

(58) Field of Classification Search
CPC ..... A42B 3/04; A42B 3/222; A42B 3/228
USPC ..... 2/422, 424, 6.3, 6.4, 6.5, 6.7, 15
See application file for complete search history.

(56) References Cited

U.S. PATENT DOCUMENTS 4,748,696 A * 6/1988 Fohl ..... A42B 3/223 2/10
5,012,528 A 5/1991 Pernicka
(Continued)

FOREIGN PATENT DOCUMENTS

DE 2640996 A1 3/1978
EP 2292112 A1 3/2011
(Continued)

*Primary Examiner* — Tejash Patel
(74) *Attorney, Agent, or Firm* — The Webb Law Firm

(57) ABSTRACT

A screen for a safety helmet, including a principal part having at least one wing with at least one linkage piece mounted thereto, where the linkage piece includes: a first arrangement for connecting the screen to the shell and configured to facilitate pivoting of the at least one linkage piece relative to the shell, such that the screen is moveable between a low position, in which the screen is substantially covering the face opening, and a high position, in which the face opening is substantially clear; and a second arrangement for connecting to the at least one wing and configured to facilitate the pivoting of the principal part relative to the at least one linkage piece; wherein the principal part is moveable relative to the at least one linkage piece between a position substantially away from and a position substantially close to the face opening.

33 Claims, 7 Drawing Sheets

(56) References Cited

U.S. PATENT DOCUMENTS

| | | | | | |
|---|---|---|---|---|---|
| 5,901,369 | A * | 5/1999 | Pilney | A42B 3/22 | 2/422 |
| 5,946,719 | A * | 9/1999 | Crupi | A41D 13/0512 | 2/410 |
| 8,286,270 | B2 * | 10/2012 | Higgins | A42B 3/185 | 2/15 |
| 2010/0132097 | A1 | 6/2010 | Chen | | |

FOREIGN PATENT DOCUMENTS

| | | | |
|---|---|---|---|
| FR | 2716089 | A1 | 8/1995 |
| WO | 9719606 | A1 | 6/1997 |
| WO | 2006088408 | A1 | 8/2006 |
| WO | 2006131558 | * | 12/2006 |

* cited by examiner

PROTECTIVE HELMET AND SCREEN

CROSS-REFERENCE TO RELATED APPLICATIONS

This application is the United States national phase of International Application No. PCT/EP2013/054810 filed Mar. 11, 2013, and claims priority to French Patent Application No. 12/52315 filed Mar. 15, 2012, the disclosures of which are hereby incorporated in their entirety by reference.

BACKGROUND OF THE INVENTION

1. Field of the Invention

The present invention relates generally to protective helmets for use in various situations and environments, and in particular to a protective helmet equipped with a view or ocular screen, a structure and arrangement for attachment to an internal portion of the external shell of a protective helmet or safety helmet.

2. Description of the Related Art

In various industries and environments, certain people, e.g., firemen, are required to wear a helmet for their protection. A helmet typically includes a shell for head protection, which includes a face opening opposite the wearer's face and a viewscreen that can be placed in front of the user's eyes. The viewscreen is generally pivotally mounted in relation to the shell about a transverse axis between a low position, in which the screen is extended relative to the face opening, and a high position, in which the face opening is substantially clear. Thus, the wearer can put the screen in the high position when circumstances do not necessitate protection of the eyes or when he wants to take the helmet off. Conversely, the screen can be lowered when the eyes must be protected. For this pivoting movement to be possible, the screen must be located at a sufficient distance from the face. However, in certain situations, the screen cannot protect the wearer effectively, particularly from elements that could be thrown from below in the direction of the face, entering the helmet through the relatively large space existing between the face and the screen.

There exist various helmet arrangements and systems for protection of the user, such as French Patent No. FR 2 716 089, which describes a helmet fitted with a viewscreen that can be moved between a high position away from the face and a low position close to the face. In this way, the space between the face and the screen can be reduced, which improves the protection conferred by the helmet. However, the system for assembling the screen described in this document involves a certain number of pieces that risk being lost, which complicates the assembly and increases the risks of poor assembly. Moreover, this system is not sufficiently robust, because it is difficult to move the screen between its different positions in either a fluid or precise manner.

Accordingly, it is desirable to provide a protective helmet and screen that addresses the issues discussed above.

SUMMARY OF THE INVENTION

Generally, provided is a protective helmet and screen that address and/or overcome some or all of the potential drawbacks and deficiencies associated with existing protective helmets utilizing or including ocular screens and similar arrangements.

For this purpose, and according to a first preferred and non-limiting embodiment, provided is a viewscreen (also referred to as a "screen" or "ocular screen") for a safety helmet including an external shell exhibiting a face opening, the screen including a principal part having a central portion and two side wings, and two linkage pieces, each mounted on a side wing, each linkage piece including:

(1) a system for connecting to the shell including a first pivoting member constructed to allow, in the position with the screen fitted onto the shell, the pivoting of the linkage piece relative to the shell about a first substantially transverse pivot axis, and thereby the movement of the screen relative to the shell between a low position, in which the screen extends relative to the face opening, and a high position, in which the face opening is substantially clear; and (2) a system for connecting to the corresponding side wing, including: a second pivoting member constructed to allow the pivoting of the principal part of the screen relative to the linkage piece about a second substantially transverse pivot axis; and a guide element configured for interacting with a complementary guide element installed on the side wing of the screen to form a linkage of the sliding type intended to guide the pivoting movement about the second pivot axis; such as to allow the movement of the principal part of the screen, relative to the linkage piece, between a position away from and a position close to the face of the helmet wearer, in the position of use, when the screen is in the low position.

Thus, the invention allows a screen movement to be achieved tending to bring it close to the face through the use of a single linkage piece on each side of the screen. This linkage piece is connected to the shell, directly or by the intermediary of one or a plurality of other pieces, through of a simple pivot axis, generally located in the rear of the linkage piece. Preferably, it is a single pivot axis, unlike some existing systems and arrangements. Further, the linkage piece is connected to the side wing by a pivot linkage and a sliding linkage, generally, at the front of the linkage piece.

Due to its simplicity, this system is quick to install and offers better long term resistance. Moreover, its operation is simple and intuitive. In effect, simple pressure on the screen toward the face can allow the screen to come close to the face, while conversely a push on the screen, from the inside of the screen toward the outside, allows the screen to move away from the face—these movements requiring no excessive force.

According to one preferred and non-limiting embodiment, the guide element installed on the connection system of the linkage piece to the corresponding side wing and the complementary guide element installed on the side wing include: a pin and/or a slit which exhibits substantially the shape of a circular arc centered on the second pivot axis. For example, the pin can be provided on the linkage piece and the slit on the side wing. The slit can be located beneath the second pivot axis. In one variation, a rod can be provided mounted on the principal part of the screen and extend into a housing arranged on a stud integral with the linkage piece. In another preferred and non-limiting embodiment, the linkage piece includes a detent suitable for interacting with a part of the side wing to restrict, toward the rear, the pivot run of the principal part of the screen about the second axis. In this manner, the detent allows the approach of the screen to the face to be limited.

According to another preferred and non-limiting embodiment, the detent is a piece distinct from the linkage piece, the linkage piece configured to receive the detent in at least two different positions, thus allowing the rear limit of the pivot run of the principal part of the screen to be adjusted about the second axis. It, therefore, involves a movable detent mounted relative to the linkage piece, which can be fixed in at least two distinct positions.

In another preferred and non-limiting embodiment, the first and/or the second pivoting member, respectively, include: a hole or a socket intended to interact with a hole or socket disposed in the shell or a piece assembled on the shell, respectively disposed at the side wing; and a friction washer configured to allow pivoting about the first or second pivot axis, respectively, when pivoting is caused by the user, but preventing said pivoting in an untimely manner. For example, the screen may include two legs, each mounted on a linkage piece, each leg being mounted in a pivoting manner on the first pivoting member and configured to be assembled on the shell. In operation, one leg can be mounted directly on the shell or on an intermediary piece itself fastened to the shell. Therefore, for example, each leg can be put into a housing installed in a ring that is fastened to the inside of the shell. Also, each leg may include a structure for locking onto the ring, which can be deactivated by a manual action of the user.

According to a further preferred and non-limiting embodiment, provided is an arrangement including a ring configured to be fastened to the inside of the external shell of a safety helmet and a viewscreen, such as that described previously, where the screen is configured to be removably mounted on the ring. In this arrangement, the principal part of the screen is located on the outside of the ring, in a mounted position and when the screen is in the high position. This arrangement can, for example, be achieved through the use of two legs, as described above.

In a further preferred and non-limiting embodiment, the screen includes a spigot projecting toward the inside, which is suitable for coming to a stop above one part of the ring in order to hold the screen in the high position, and which can go beyond the part downward, upon the manual action of a user. Thus, the voluntary passage beyond this part of the ring leads to locking or unlocking the screen. However, when the screen is in the high position, it cannot go to the low position in an untimely manner, which could occur simply by its weight or upon the action of a moderate shock, such as that which could be produced when a fireman wearing the helmet jumps from a truck.

In addition, the ring can include an element projecting toward the outside, configured to interact with a support zone arranged on the screen when the screen is moved from its low position and close to the face to its high position, in such a way as to cause, during this movement, the pivoting of the principal part of the screen about the second pivot axis, in the direction of moving away from the face. This arrangement allows rubbing of the screen against the ring to be avoided, which would risk scratching it. It is to be noted that this projection and the aforementioned part of the ring can be one and the same element.

According to one preferred and non-limiting embodiment, the support zone includes a channel disposed on the inside of the screen, substantially at the junction between the principal portion and a side wing. This channel has a cross-section forming an acute angle, and, in a side view, a curved bottom edge concave toward the inside. Moreover, the projection disposed on the ring exhibits, in cross-section, a pointed shape complementary to the cross-section of the channel, such that the projection could be guided into the channel, and a front edge inclined to the rear and upward, which is disposed substantially parallel to the edge forming the bottom of the channel when the screen is in its position away from the face.

Consequently, if the screen is in its position away from the face, the interaction of the projection and the channel results in the simple guiding of the shift movement of the screen upward. Conversely, if the screen is in its position close to the face, the interaction of the projection and the channel forces the pivoting of the principal part of the screen about the second axis so that the front side of the projection and the edge forming the base of the channel become roughly parallel.

In a preferred and non-limiting embodiment, the assembly is symmetric, i.e., it is provided with a projection on each side of the ring and two channels on the screen. The channel can be formed by an indentation toward the inside of the principal portion of the screen.

According to another preferred and non-limiting embodiment, provided is a safety helmet including an external shell and a screen or an arrangement, as described above.

In another preferred and non-limiting embodiment, provided is a screen for a safety helmet having an external shell with a face opening, the screen including: a principal part having at least one wing with at least one linkage piece mounted on the at least one wing, the at least one linkage piece including: a first arrangement for connecting the screen to the shell and configured to facilitate pivoting of the at least one linkage piece relative to the shell, such that the screen is moveable between a low position, in which the screen is substantially covering the face opening, and a high position, in which the face opening is substantially clear; and a second arrangement for connecting to the at least one wing and configured to facilitate the pivoting of the principal part relative to the at least one linkage piece; wherein the principal part is moveable relative to the at least one linkage piece between a position substantially away from and a position substantially close to the face opening.

In a further preferred and non-limiting embodiment, provided is a safety helmet attachment arrangement for attaching a screen to a safety helmet having an external shell with a face opening, the arrangement including: a principal part of the screen having at least one wing with at least one linkage piece mounted on the at least one wing, the at least one linkage piece including: (1) a first arrangement for connecting the screen to the shell and configured to facilitate pivoting of the at least one linkage piece relative to the shell, such that the screen is moveable between a low position, in which the screen is substantially covering the face opening, and a high position, in which the face opening is substantially clear; and (2) a second arrangement for connecting to the at least one wing and configured to facilitate the pivoting of the principal part relative to the at least one linkage piece; wherein the principal part is moveable relative to the at least one linkage piece between a position substantially away from and a position substantially close to the face opening; and a ring configured to be attached to a portion of the external shell, wherein the screen is removably mounted on the ring, and wherein the principal part of the screen is located on the outside of the ring in a mounted position and when the screen is in a high position.

In a still further preferred and non-limiting embodiment, provided is a safety helmet, including: an external shell having a face opening; and a screen; wherein a principal part of the screen having at least one wing with at least one linkage piece mounted on the at least one wing, the at least one linkage piece including: (1) a first arrangement for connecting the screen to the shell and configured to facilitate pivoting of the at least one linkage piece relative to the shell, such that the screen is moveable between a low position, in which the screen is substantially covering the face opening, and a high position, in which the face opening is substantially clear; and (2) a second arrangement for connecting to the at least one wing and configured to facilitate the pivoting of the principal part relative to the at least one linkage piece; wherein the principal part is moveable relative to the at least one linkage piece between a position substantially away from and a position substantially close to the face opening.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1:
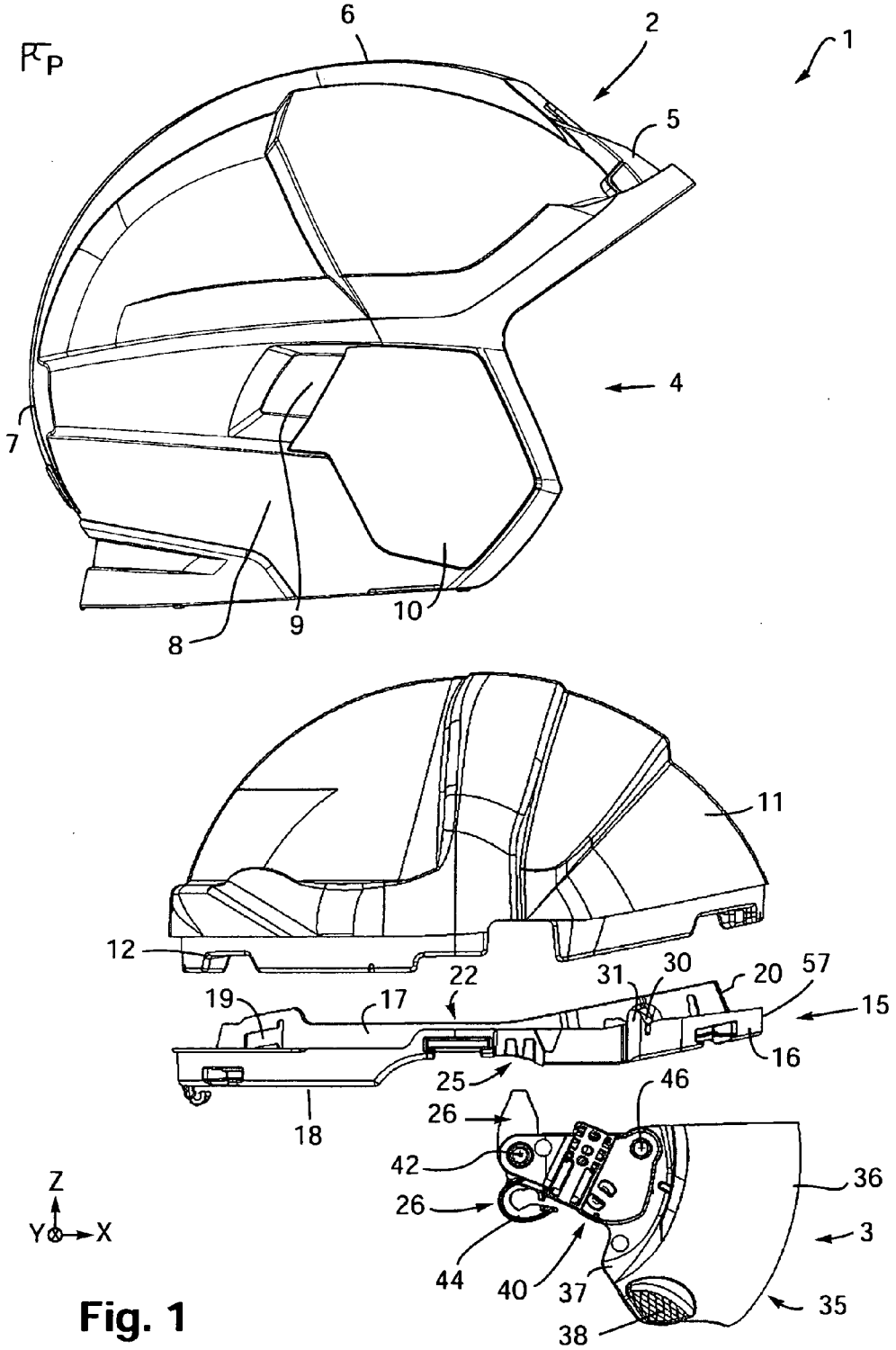
FIG. 1 is a side and exploded side view of a helmet according to the principles of the present invention.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. It is to be understood that the invention may assume various alternative variations, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

The present invention relates to a protective helmet and screen, as illustrated in certain preferred and non-limiting embodiments in FIGS. 1-15.

In one preferred and non-limiting embodiment, and as illustrated in FIG. 1, provided is a helmet 1, which includes a structure having a rigid, external shell 2 and an internal module fastened in the shell 2; and a viewscreen 3 intended to protect the eyes of the user, which is removably joined to the structure. The helmet 1 can also include a face shield (not shown). The shell 2 is intended to enclose the head of a user and is, for example, manufactured from a composite or thermoplastic material. The shell 2 has a longitudinal plane of symmetry P.

Hereinafter, the helmet 1 is described in the position of use, i.e., in the position it occupies when it is placed on the head of the wearer when standing up straight. The transverse direction Y is defined as the direction orthogonal to the plane P (this direction therefore being substantially horizontal). The longitudinal direction X is defined as the direction orthogonal to Y and substantially horizontal, and the direction Z is the vertical direction. The term "inner" is used to designate an element closer to the head of the wearer, in opposition to the term "outer". The terms "upper", "lower", "top", and "bottom" are used in reference to the Z direction. The terms "front" and "rear" are used in reference to the X direction. The terms "side", "left", "right", and "transverse" are used in reference to the Y direction.

The shell 2 exhibits a generally spherical shape and includes a face opening 4 for the face of the wearer. The shell 2 includes: a front portion 5 located above the face opening 4, an upper portion 6, a rear portion 7 extending from the upper portion 6 to the nape of the wearer, as well as a left side portion and a right side portion 8, each extending from the upper portion 6 on either side of the face opening 4. In this embodiment, each side portion 8 includes a recess 9 toward the inside. A plate 10 is fastened on each side portion 8 of the shell 2, so as to cover at least in part this recess 9. In one preferred and non-limiting embodiment, the plates 10 are substantially flush with the zones of the helmet 1 located around the recess 9, in order for the shell 2 to exhibit in this zone an outer surface substantially without an indentation. The plate 10 can also be used to hook on a connection device for a breathing mask.

Figure 2:
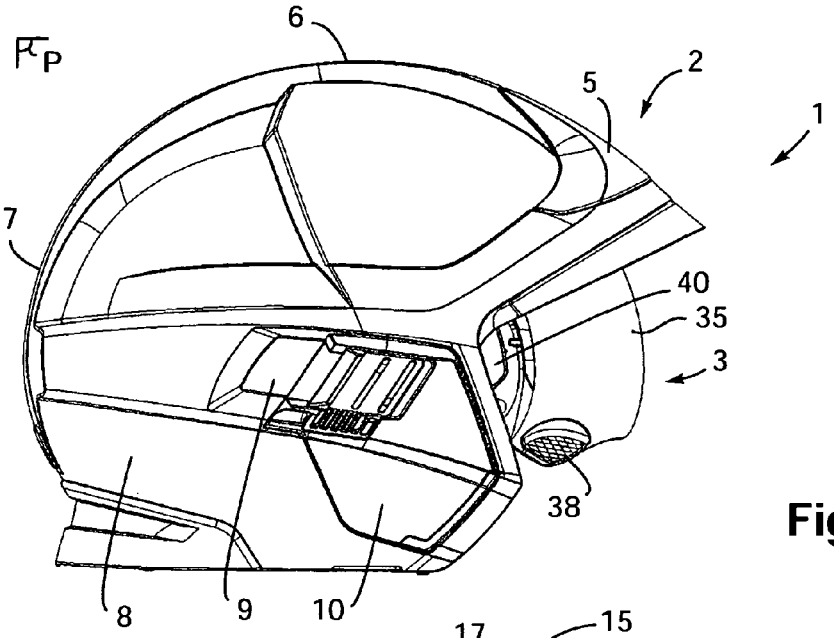
FIG. 2 is a side view of the helmet of FIG. 1 in a mounted position, the screen being in the low position away from the face.

The inner module includes a cap 11, which allows shocks to be absorbed and which is, for example, manufactured as a dense foam. In one preferred and non-limiting embodiment, the cap 11 includes a bulging shape and a lower, substantially oval part 12. The inner module also includes a ring 15 mounted in the lower part of the cap 11. As is seen in FIG. 2, the ring 15 has a substantially oval shape that is similar to that of the lower portion of the cap 11. Moreover, the ring 15 possesses one substantially U-shaped section on which the lower part 12 of the cap 11 will be mounted. In another preferred and non-limiting embodiment, the inner module includes a cap intended for the comfort of the wearer, an adjustable headband, and a chin strap (not shown), all preferably mounted on the ring 15. The ring 15 forms the support of various elements of the helmet 1, and further includes or is formed with an arrangement for removably fastening the internal module onto the helmet 2.

Figure 3:
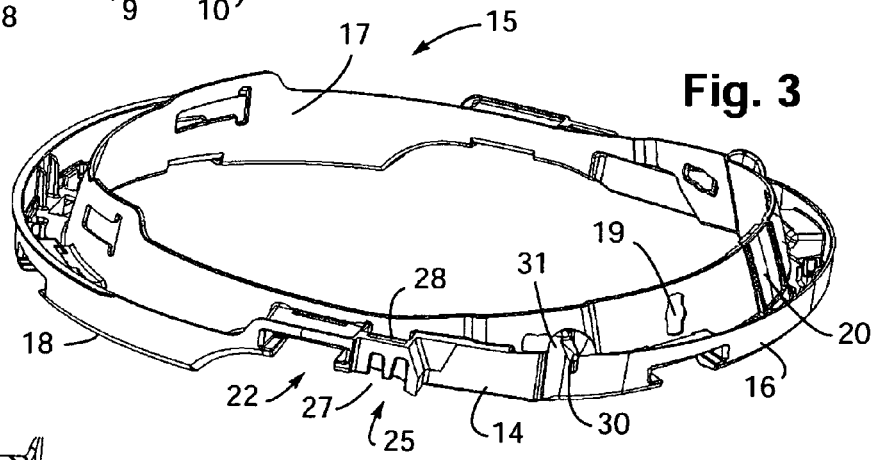
FIG. 3 is a perspective view of a ring for use in connection with the helmet of FIG. 1 and according to the principles of the present invention.

In one preferred and non-limiting embodiment, and as illustrated in FIG. 3, the ring 15 includes an outer wall 16 and an inner wall 17, which are substantially oval and parallel, connected by a lower wall 18 forming the bottom of the U-shaped section of the ring 15. In one preferred and non-limiting embodiment, the inner wall 17 exhibits an average height greater than the average height of the outer wall 16. Further, orifices or openings 19 can be arranged in the inner wall 17, which are used for installing a headband and, in front, a slide 20 for accepting a tongue for adjusting the position of the said headband. Orifices or openings can be provided in the lower wall 18 to accept straps crossing above the head of the wearer.

On the side and at each side (left and right) of the ring 15, a housing 25 is provided to receive a leg 26 fitted to the viewscreen 3 for mounting this screen 3 onto the ring 15. Further, a reception cavity 22 is provided for use as or with a fastener (not depicted) for the ring 15 onto the shell 2, and this cavity 22 is preferably located at the rear of the housing 25, in order not to hinder the pivoting of the screen 3.

In this embodiment, the housing 25 includes a conduit with substantially vertical axis which, in the embodiment represented, possesses a substantially rectangular cross-section, i.e., in the X-Y plane. The housing 25 includes an open, lower end 27 located in the inner wall 18 of the ring 15 and can also include an open, upper end 28. In another preferred and non-limiting embodiment, in front of the zone of the ring 15, where the cavity 22 and the housing 25 are located, the outer wall 16 includes a substantially planar and longitudinal portion 14 forming an indentation toward the inside (in contrast to the continuity of the oval shape of the remainder of this outer wall 16). Moreover, at the side and on each side, the ring 15 includes a stud 30 projecting outward from the outer wall 16. The stud 30 is located in front of the corresponding housing 25, and, for example, is partly in front of the portion 14 of the ring 15. In another preferred and non-limiting embodiment, each side of the ring 15 includes an appendage 31 of the outer wall 16, extending upward, from which appendage 31 the stud 30 projects.

Figure 4:
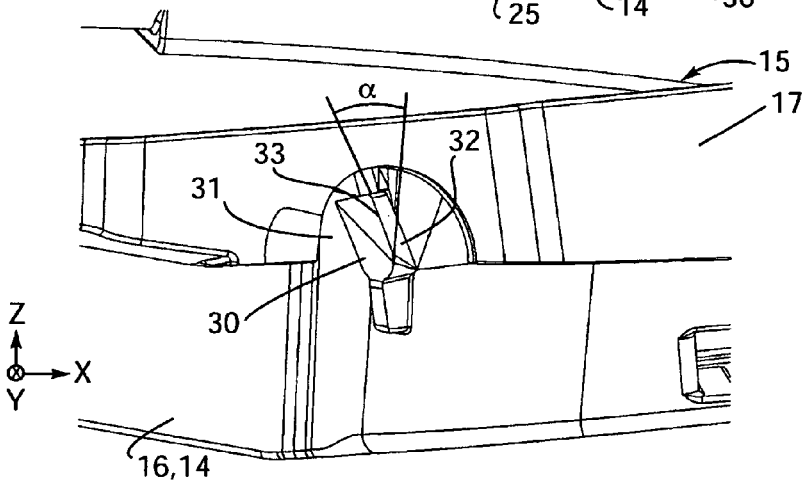
FIG. 4 is a detailed, perspective view of a portion of the ring of FIG. 3.
Figure 5:
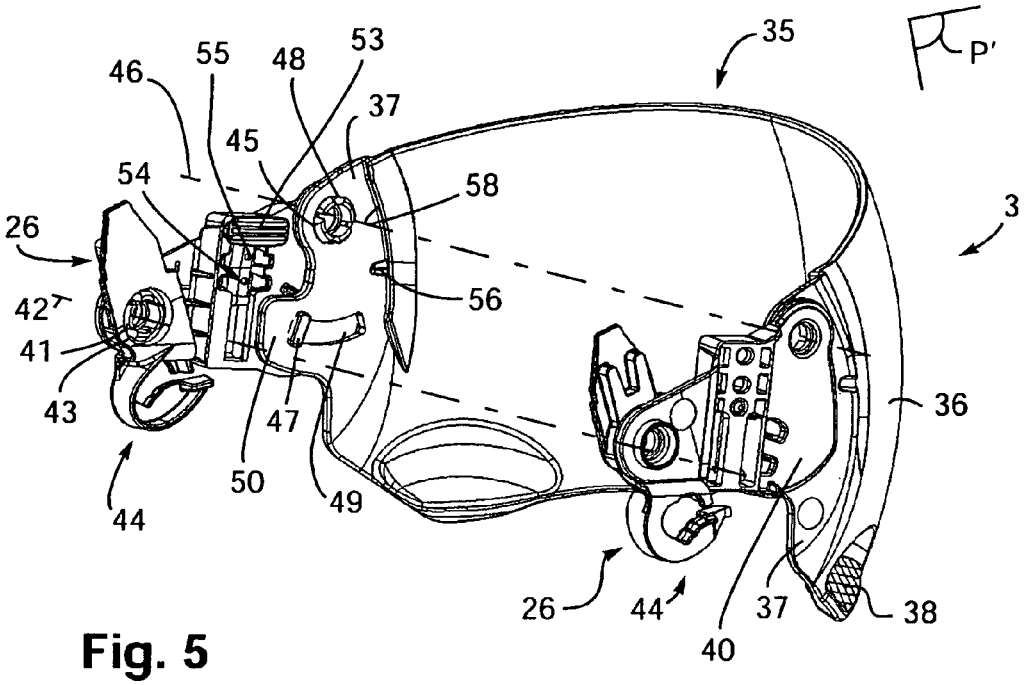
FIG. 5 is a perspective view of a screen for use in connection with the helmet of FIG. 1 and according to the principles of the present invention.
Figure 6:
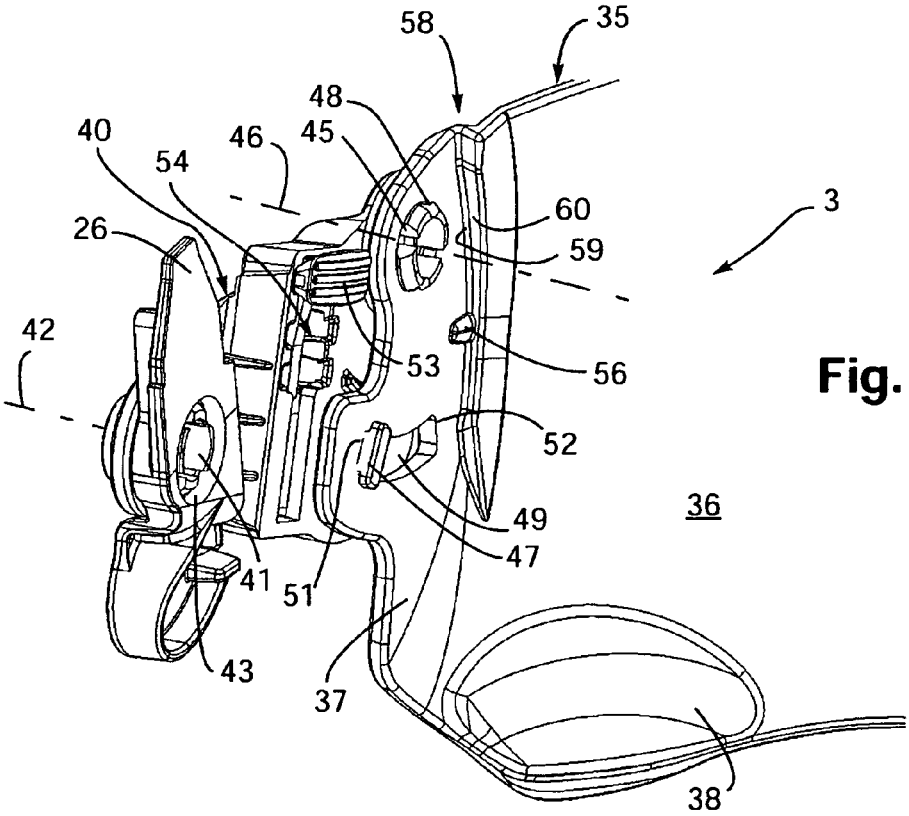
FIG. 6 is a detailed, perspective view of a portion of the screen of FIG. 5.
Figure 13:
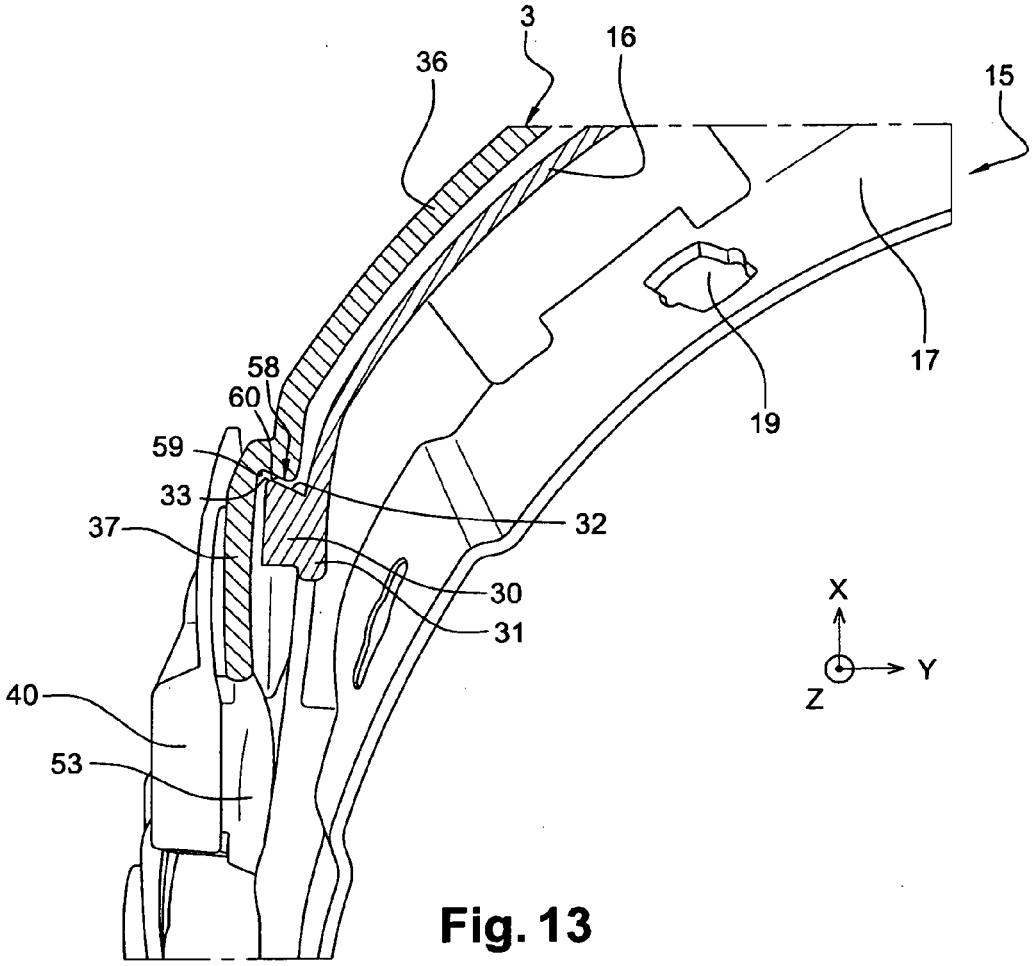
FIG. 13 is a plan view of the screen and ring of FIG. 7*a* illustrating the interaction of the stud of FIG. 4 and the channel of FIG. 6.

Each stud 30 includes a front side 32 inclined toward the rear and upward at an angle (a) from the vertical, which can be between about 20° and about 40°. In addition, in cross-section, each stud 30 includes a shape pointing forward, the front side 32 inclined forward from the base of the stud 30 connected to the screen 3 in the outward direction (see FIG. 13). In this manner, each stud 30 has a front pointed edge 33 (as best shown in FIGS. 4 and 13), which is inclined toward the rear and upward at an angle (a).

In one preferred and non-limiting embodiment, the screen 3 includes a longitudinal plane of symmetry P' which merges substantially with the plane P in the position mounted on the helmet 1. The screen 3 includes: a principal part 35 including a central portion 36 through which the wearer can see his surroundings; and two side wings 37, which allow the screen 3 to be mounted on the structure. In one preferred and non-limiting embodiment, the side wings 37 arc formed of one piece with the central portion 36 and are in the form of side extensions. In another preferred and non-limiting embodiment, the central portion 36 includes a notch for the nose (not visible in the figures) and two side zones 38 for grasping, thereby allowing a user to manipulate the screen 3 for its movement between its different positions. The screen 3 also includes two linkage pieces 40, each mounted on a side wing 37, which are substantially identical.

In the rear part, the linkage piece 40 includes a system for connecting to the shell 2. In the illustrated embodiment, a socket 41 is provided with a substantially transverse axis 42 projecting from the linkage piece 40 toward the inside. The socket 41 facilitates the pivotal assembly of the leg 26 about a first pivot axis 42. In one preferred and non-limiting embodiment, the viewscreen is mounted directly on the shell 2 itself, with the possible function of pivoting about a substantially transverse axis.

In one preferred and non-limiting embodiment, the leg 26 includes a body, which is substantially flat and rectangular, and in which a hole 43 is provided, for example, in the central part of the leg 26. The hole 43 can be clipped on the socket 41. For this purpose, the socket 41 may include axial slits and a radial end-flange, which allows the assembly and retention of the leg 26, through elastic deformation of the socket 41, as well as the rotation of the leg 26 about the axis 42.

In another preferred and non-limiting embodiment, a friction washer is interposed between the leg 26 and the linkage piece 40, so as to produce some resistance to relative pivoting of these two pieces. Thus, pivoting about the axis 42 can be achieved by the voluntary action of a user, but it does not result in untimely or accidental pivoting, at least in the absence of a large shock. The leg 26 is configured to be positioned on or with respect to the corresponding housing 25 of the ring 15, for mounting the screen 3 onto the structure of the helmet 1. In operation, the leg 26 is introduced from the bottom upward, through the lower, open end 22 of the housing 25.

At least one leg, and preferably the two legs 26, also includes an arrangement for locking onto the structure of the helmet 1. In one preferred and non-limiting embodiment, this arrangement is integrally located on the inside of the shell 2, in the position of use, and can be unlocked by a manual action of the user. Accordingly, the legs 26 may serve the dual function of facilitating the mounting of the screen 3 on the structure, and locking in the mounted position, where the screen 3 retains its ability to be raised and lowered. In the illustrated embodiment, the locking arrangement includes hooks 44 arranged on the legs 26, preferably in its lower part, which will interact with pins (not depicted) installed on the inside of the shell 2. In one preferred and non-limiting embodiment, the leg 26 includes a clipping projection in the housing 25.

In one preferred and non-limiting embodiment, and located in the front part, the linkage piece 40 includes a system and/or arrangement for connecting to the corresponding side wing 37. In this embodiment, the connection system includes: a socket 45 with a substantially transverse axis 46 projecting from the linkage piece 40 toward the inside; and a linkage piece 40 having a pin 47 also projecting to the inside. The pin 47 may include a substantially radial rod and an enlarged head. Further, and in this embodiment, the socket 45 is located in the upper part of the linkage piece 40, and the pin 47 is disposed below the socket 45, being offset back toward the rear relative to the former. In a complementary manner, the side wing 37 of the screen 3 includes a hole 48 and a slit 49 that exhibits substantially the shape of a circular arc centered on the axis 46. In addition, the side wing 37 includes a tongue 50 forming a lower extension toward the rear, located, for example, roughly at the level of the slit 49.

The socket 45 serves in the pivot mounting of the side wing 37 about the axis 46, forming a second pivot axis, where the hole 48 of the side wing 37 is clipped at the socket 45. For this purpose, the socket 45 can include axial slits and a radial end-flange, which allows assembly and retention of the side wing 37, through elastic deformation of the socket 45, as well as the rotation of the side wing 37 about the axis 42.

In one preferred and non-limiting embodiment, a friction washer is interposed between the side wing 37 and the linkage piece 40, so as to produce some resistance to relative pivoting of these two pieces. Thus, pivoting about the axis 46 can be achieved by the voluntary action of a user, but it does not produce untimely or accidental pivoting, at least without a large shock. In this embodiment, the pin 47 is put into the slit 49 and cannot get out of it in an untimely manner due to its enlarged head. The pin 47 and the slit 49 form a linkage of the slide type, which allows the pivoting movement to be guided about the second pivot axis 46.

Figure 7A:
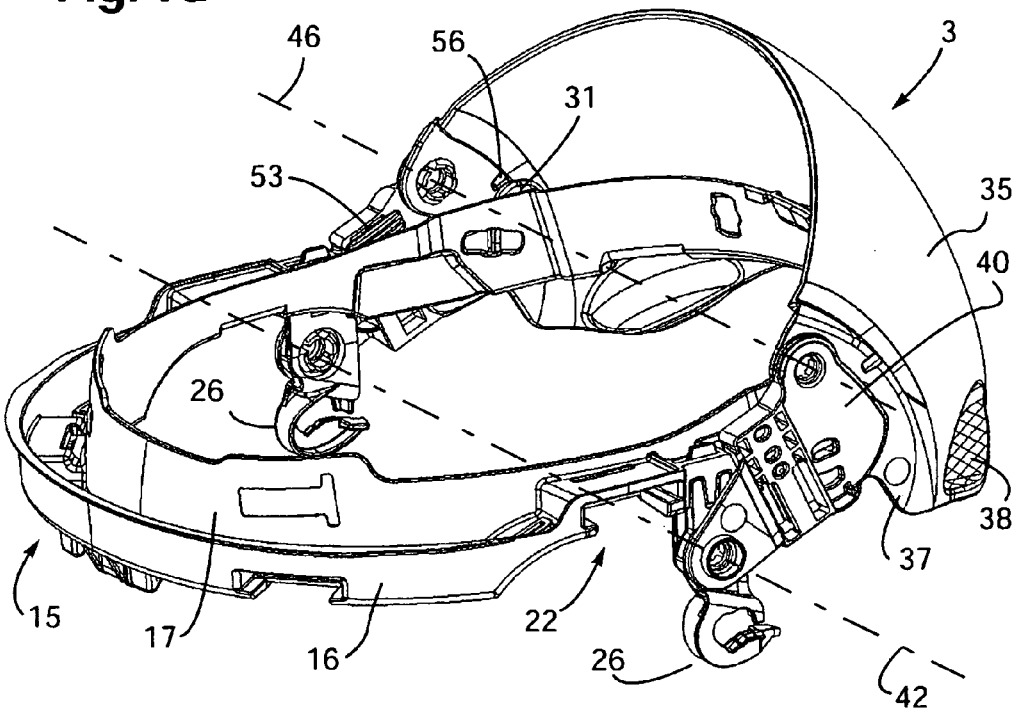
FIG. 7*a* is a perspective view of the screen of FIG. 5 mounted on the ring of FIG. 3.
Figure 7B:
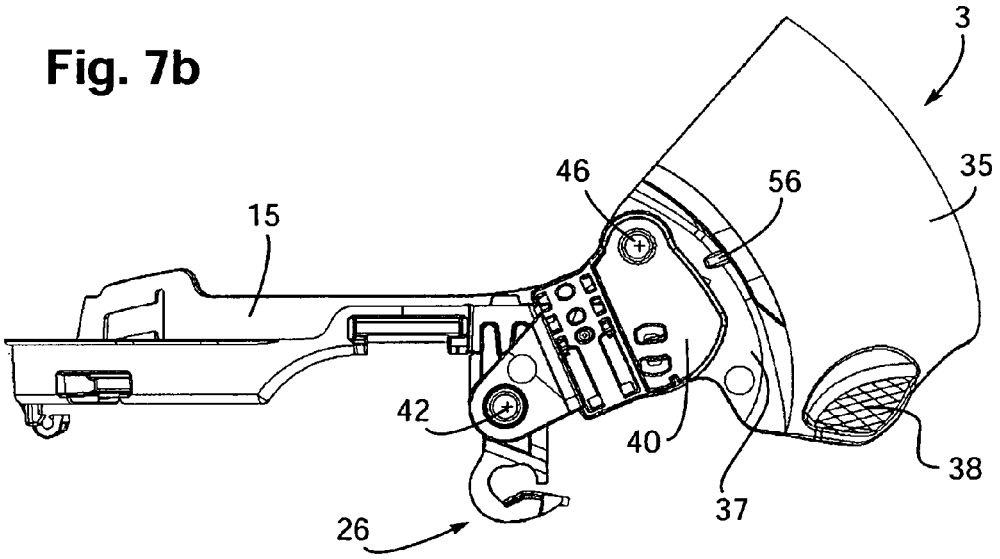
FIG. 7*b* is a side view of the screen and ring of FIG. 7*a;*
Figure 8:
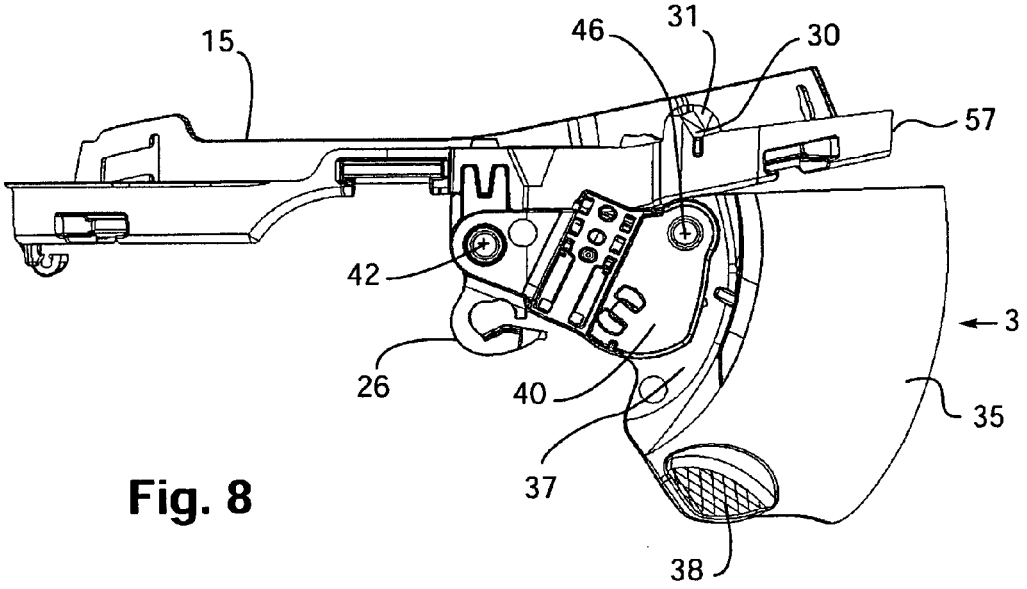
FIG. 8 is a side view of the screen and ring of FIG. 7*a* in the low position away from the face.
Figure 9:
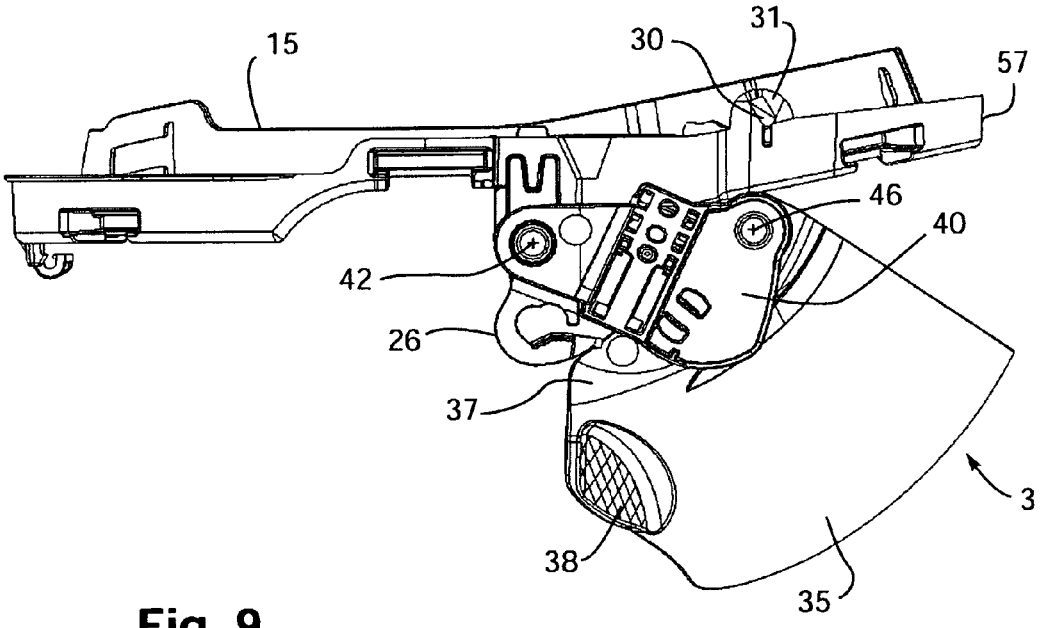
FIG. 9 is a side view of the screen and ring of FIG. 7*a* in the low position close to the face.

In operation, and in the position of use, the screen 3 is mounted on the shell 2, by the intermediary of the legs 26 removably set into the housings 25 of the ring 15. As is seen in FIGS. 7*a*, 7*b*, 8, and 9, the screen 3 can occupy different positions relative to the shell 2 of the helmet 1. In particular, and as illustrated in FIGS. 7*a* and 7*b*, the screen 3 can be in a high position, in which the face opening 4 of the helmet 1 is substantially clear. The principal part 35 of the screen 3 is then located on the outside of the ring 15 (i.e., in front of the ring 15). By pivoting the linkage piece 40 relative to the leg 26, i.e., relative to the shell 2, about the first pivot axis 42, the screen 3 can be moved toward its low position, in which the screen 3 is extended opposite the face opening 4, in front of the user's eyes. In FIG. 8, the screen 3 is illustrated in the low position and away from the face, the pin 47 being located toward the rear end 51 of the slit 49. Starting from the position illustrated in FIG. 8, it is possible to move the screen 3 to bring it close to the user's face, for example, by simple pressure on the principal part 35 of the screen 3.

In one preferred and non-limiting embodiment, the principal part 35 of the screen 3 pivots relative to the linkage piece 40 about the second pivot axis 46, this movement being guided by the pin 47 running in the slit 49. When the pin 47 is located toward the front end 52 of the slit 49, the principal part 35 of the screen 3 is in position close to the face (FIG. 9), the screen 3 always being in the low position.

Due to the fact that the principal part 35 of the screen 3 comes close to the face of the helmet 1 wearer, improved protection to the user's face is provided. However, if the user wears glasses, which prevent too close of an approach of the screen 3 to the face, it is sufficient for them to keep the screen 3 in the position away from the face (as in FIG. 8). The helmet 1 according to the invention therefore remains suited to wearers of glasses.

For various reasons, it may be desired to be able to limit the approach of the screen 3 to the face of the helmet 1 wearer and to fix this limit at a predetermined value. For this purpose, a detent 53 can be provided on the linkage piece 40, configured for interacting with the tongue 50 of the side wing 37 to limit, toward the rear, the pivot run of the principal part 35 of the screen 3 about the second axis 46. In operation, the tongue 50 will interact with the lower side of the detent 53.

Figure 10:
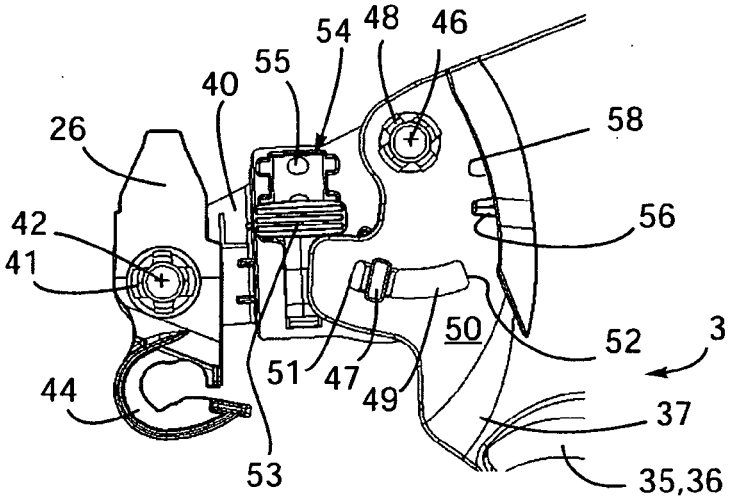
FIG. 10 is a side view of a portion the screen of FIG. 4 in a first position.
Figure 11:
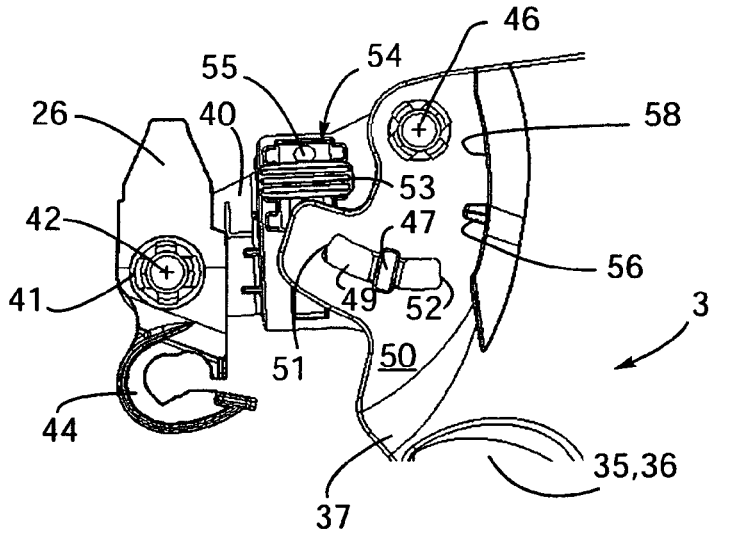
FIG. 11 is a side view of the portion the screen of FIG. 10 in a second position.
Figure 12:
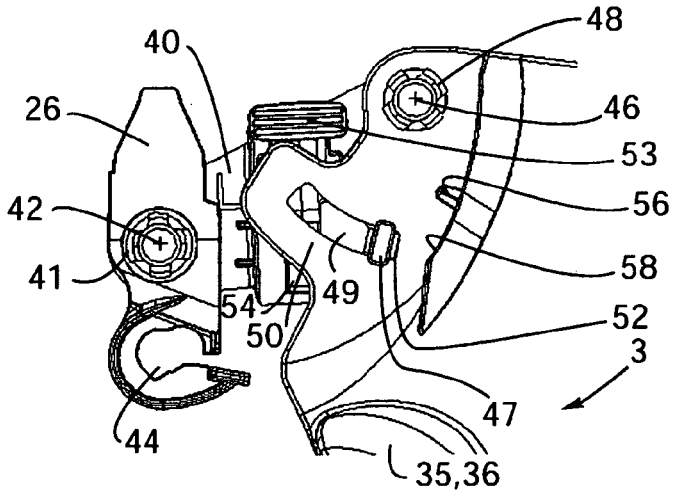
FIG. 12 is a side view of the portion the screen of FIG. 10 in a third position.

As illustrated in FIGS. 10-12, the detent 53 is a piece distinct from the linkage piece 40 and is mounted movably, for example, in a groove 54 disposed substantially vertically on the lower side of the linkage piece 40. The groove 54 includes an arrangement for receiving the detent in several different positions, e.g., three positions. In one preferred and non-limiting embodiment, the bottom of the groove 54 includes three orifices or openings 55 vertically and substantially equally spaced, and the detent 53 includes a dowel projecting outward suitable for lodging in one of these three orifices or openings 55. When the dowel of the detent 53 is lodged in the highest orifice or opening 55, the detent 53 is in the high position (FIG. 12). This facilitates the full movement of the approach of the screen 3 to the face. In operation, when the tongue 50 of the side wing 37 comes against or contacts the detent 53, the pin 47 is located against the front end 52 of the slit 49, and pivoting of the principal portion 35 of the screen 3 about the axis 46 (in the direction of approach to the face) is prevented.

Further, the detent 53 can be fixed at an intermediate level, its dowel being lodged in the orifice or opening 55 in the middle. In this case (FIG. 11), only a part of the maximum pivot is possible about the axis 46. For example, the arrangement can be constructed so that about half the pivot is allowed, the pin 47 thus being found in its extreme rear position at the end of movement, substantially in the middle of the slit 49. Finally, the detent can be fixed in the low position, its dowel being lodged in the lowest orifice or opening 55 of the groove 54 of the linkage piece 40 (FIG. 10). In this case, substantially the full pivoting movement about the axis 46 is permitted by the slit 49. Accordingly, when the tongue 50 of the screen 3 comes against the detent 53, the pin 47 is located substantially against the rear end 51 of the slit 49.

In one preferred and non-limiting embodiment, the screen 3 is held in the low position by the action of gravity. In another preferred and non-limiting embodiment, the screen 3 is held in a high or intermediate position, to some degree, by the friction washers. However, this may turn out to be insufficient in certain cases, such as if a large shock is experienced.

In another preferred and non-limiting embodiment, a spigot 56 is provided on the screen 3, where this spigot 56 projects toward the inside and is configured to interact with the appendage 31 or the stud 30 disposed on the ring 15. In operation, and in one preferred and non-limiting embodiment, the spigot 56 is located substantially at the junction between the side wing 37 and the central portion 36 of the principal part 35 of the screen 3. When the spigot 56 is at the detent above the appendage 31 or the stud 30, it allows the screen 3 to be held in the high position more efficiently than with friction washers. This embodiment is configured, such that a user could, by operating manually upon the screen 3, cause the spigot 56 to go beyond the appendage 31 or the stud 30, downward when the screen 3 is lowered, or possibly upward if the screen 3 is raised.

In one preferred and non-limiting embodiment, the stud 30 provides another function. Specifically, when the screen 3 is in the low position and close to the face (FIG. 9) and a user raises the screen 3 to its high position, one risk is that the inside of the central portion 36 of the screen 3 will come in contact with the front edge 57 of the ring 15, risking potential scratching. In order to avoid such damage to the screen 3, a channel 58 is provided on the screen 3, disposed on the inside of the screen 3, substantially at the junction between the principal portion 36 and a side wing 37. According to this embodiment, the channel 58 is formed by an indentation toward the inside of the principal portion 35 of the screen 3 (see FIGS. 6 and 13).

The channel 58 forms a guide and support zone for the stud 30 and therefore has a shape complementary to that of the stud 30. Further, the channel 58 has a cross-section forming an acute angle corresponding to the pointed cross-section of the stud 30, with the front side 32 inclined in a transverse plane. Moreover, in a side view, the channel 58 has a curved bottom edge 59, concave toward the inside. In this manner, when the screen 3 is moved from its low position away from the face to its high position, the stud 30 is simply guided into the channel 58. The front side 32 of the stud 30 is substantially parallel to the zone opposite the side 60 of the channel 58 turned rearward, and the front pointed edge 33 of the stud 30 follows the edge 59 during this movement of raising the screen 3.

Figure 14:
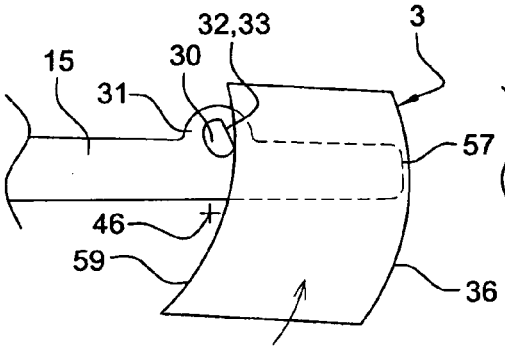
FIGS. 14 and 15 are schematic side views of the stud and channel of FIG. 13 when when the screen is moved from its low position close to the face to its high position.
Figure 15:
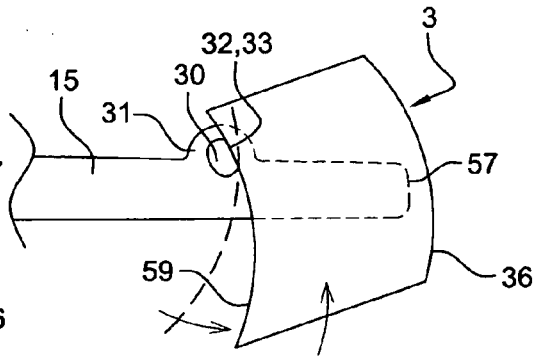

When the screen 3 is moved from its low position close to the face to its high position, the interaction between the stud 30 and the channel 58 causes, during this movement, the pivoting of the principal part 35 of the screen 3 about the second pivot axis 46, in the direction away from the face, as illustrated schematically in FIGS. 14 and 15, until the front edge 33 of the stud 30 is disposed roughly parallel to the edge 59 forming the bottom of the channel 58. In this way, the risk is avoided that the front edge 57 of the ring 15 would rub against the inside of the central portion 36 of the screen 3.

It is understood that the invention is not limited to the embodiments described above by way of examples but that it comprises all the technical equivalents and the variants of the means described as well as their combinations. Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A viewscreen for a safety helmet including an external shell exhibiting a face opening, the screen comprising a principal part having a central portion and two side wings, and two linkage pieces, each mounted on a side wing, each linkage piece comprising:

a system for connecting to the shell comprising a first pivoting member constructed to allow, in the position with the screen mounted on the shell, the pivoting of the linkage piece relative to the shell about a first roughly transverse pivot axis and thus the movement of the screen relative to the shell between a low position, in which the screen is extended relative to the face opening, and a high position, in which the face opening is substantially clear; and a system for connecting to the corresponding side wing comprising:

a second pivoting member constructed to allow the pivoting of the principal part of the screen relative to the linkage piece about a second roughly transverse pivot axis; and a guide element suitable for interacting with a complementary guide element installed on the side wing of the screen to form a linkage of the sliding type intended to guide the pivoting movement about the second pivoting axis;

such that the principal part of the screen is moveable relative to the linkage piece between a position away from and a position close to the face of the helmet wearer, in the position of use, when the screen is in the low position.

2. The screen according to claim 1, wherein the guide element installed on the connection system of the linkage piece at the corresponding side wing comprises a pin and said complementary guide element installed on the side wing comprises a slit which exhibits substantially the shape of a circular arc centered on the second pivot axis.

3. The screen according to claim 1, wherein the linkage piece includes a detent suitable for interacting with a part of the side wing to restrict, toward the rear, the pivot run of the principal part of the screen about the second axis.

4. The screen according to claim 3, wherein the detent is distinct from the linkage piece, and in that the linkage piece includes means of receiving the detent in at least two different positions, thus allowing the rear limit of the pivot run of the principal part of the screen o be adjusted about the second axis.

5. The screen according to claim 1, wherein the first and/or the second pivoting member, respectively, includes:

a hole or a socket configured to interact with a hole or socket disposed in the shell or a piece assembled on the shell, respectively disposed on the side wing; and a friction washer constructed to allow pivoting about the first or second pivot axis, respectively, when this pivoting is caused by the user, but preventing said pivoting in an untimely manner.

6. The screen according to claim 1, further including two legs respectively mounted on the two linkage pieces, each leg being mounted in a pivoting manner on the first pivoting member and configured to be assembled on the shell.

7. An arrangement, comprising: a ring configured to be fastened to the inside of the external shell of a safety helmet; and a viewscreen according to claim 1, the screen configured to be removably mounted on the ring, the principal part of the screen being located on the outside of the ring in a mounted position and when the screen is in the high position.

8. The arrangement according to claim 7, wherein the screen includes a spigot projecting toward the inside, which is suitable for coming to a detent above one part of the ring in order to hold the screen in the high position, and which can go beyond said part downward upon the manual action of a user.

9. The arrangement according to claim 7, wherein the ring includes an element projecting toward the outside, configured to interact with a support zone arranged on the screen when the screen is moved from its low position and close to the face to its high position, in such a way as to cause, during this movement, the pivoting of the principal part of the screen about the second pivot axis, in the direction away from the face.

10. The arrangement according to claim 9, wherein the support zone includes a channel disposed on the inside of the screen, substantially at the junction between the principal portion and a side wing, the channel exhibiting a cross-section forming an acute angle, and a curved bottom edge, concave toward the inside, and in that the projecting element disposed on the ring includes a pointed shape complementary to the cross-section of the channel, such that said projecting element is guidable into the channel, and a front edge inclined to the rear and upward, which is disposed roughly parallel to the edge forming the bottom of the channel when the screen is in its position away from the face.

11. The arrangement according to claim 10, wherein the channel is formed by an indentation toward the inside of the principal portion of the screen.

12. A safety helmet, comprising the viewscreen according to claim 1.

13. A screen for a safety helmet having an external shell with a face opening, the screen comprising:

a principal part having at least one wing with at least one linkage piece mounted on the at least one wing, the at least one linkage piece comprising:

a first arrangement for connecting the screen to the shell and configured to facilitate pivoting of the at least one linkage piece relative to the shell, such that the screen is moveable between a low position, in which the screen is substantially covering the face opening, and a high position, in which the face opening is substantially clear; and a second arrangement for connecting to the at least one wing and configured to facilitate the pivoting of the principal part relative to the at least one linkage piece;

wherein the principal part is moveable relative to the at least one linkage piece between a position substantially away from and a position substantially close to the face opening when the screen is in the low position.

14. The screen of claim 13, wherein the first arrangement comprises at least one pivoting member for facilitating the pivoting, when the screen is mounted on the shell, of the at least one linkage piece relative to the shell about a first pivot axis.

15. The screen of claim 14, wherein the second arrangement comprises at least one pivoting member for facilitating the pivoting of the principal part relative to the at least one linkage piece about a second pivot axis.

16. The screen of claim 15, wherein at least one of the at least one first pivoting member and the at least one second pivoting member comprises:

a hole or socket configured to interact with a hole or socket positioned on or in the shell; and at least one friction washer configured to facilitate the pivoting about the first axis or the second axis when the pivoting is initiated by a user.

17. The screen of claim 14, further comprising at least one leg mounted on the at least one linkage piece, wherein the at least one leg is pivotally mounted on the at least one first pivoting member and configured for attachment to the shell.

18. The screen of claim 13, wherein the second arrangement further comprises at least one guide element configured for interaction with at least one guide element on the at least one wing to facilitate the guided pivoting of the principal part relative to the at least one linkage piece.

19. The screen of claim 18, wherein the at least one guide element of the second arrangement comprises at least one pin, and the at least one guide element of the at least one wing comprises at least one slit.

20. The screen of claim 19, wherein the at least one slit has a substantially circular arc shape centered on a pivot axis of the second arrangement.

21. The screen of claim 18, wherein the at least one guide element of the second arrangement comprises at least one slit, and the at least one guide element of the at least one wing comprises at least one pin.

22. The screen of claim 21, wherein the at least one slit has a substantially circular arc shape centered on a pivot axis of the second arrangement.

23. The screen of claim 13, where the at least one linkage piece comprises a detent configured to interact with a portion of the at least one wing and restrict the pivoting of the principal part relative to the at least one linkage piece.

24. The screen of claim 23, wherein the detent is distinct from the at least one linkage piece, which includes an arrangement for receiving the detent in at least two different positions, thereby facilitating the adjustability of the pivoting of the principal part.

25. A safety helmet attachment arrangement for attaching a screen to a safety helmet having an external shell with a face opening, the arrangement comprising:

a principal part of the screen having at least one wing with at least one linkage piece mounted on the at least one wing, the at least one linkage piece comprising: a first arrangement for connecting the screen to the shell and configured to facilitate pivoting of the at least one linkage piece relative to the shell, such that the screen is moveable between a low position, in which the screen is substantially covering the face opening, and a high position, in which the face opening is substantially clear; and a second arrangement for connecting to the at least one wing and configured to facilitate the pivoting of the principal part relative to the at least one linkage piece; wherein the principal part is moveable relative to the at least one linkage piece between a position substantially away from and a position substantially close to the face opening; and a ring configured to be attached to a portion of the external shell, wherein the screen is removably mounted on the ring, and wherein the principal part of the screen is located on the outside of the ring in a mounted position and when the screen is in a high position.

26. The safety helmet attachment arrangement of claim 25, wherein the screen comprises a spigot projecting therefrom, which is configured to contact a detent positioned above a portion of the ring, such as to hold the screen in the high position, but which may move beyond the portion of the ring through manual action of a user.

27. The safety helmet attachment arrangement of claim 25, wherein the ring further comprises a projecting element configured to interact with a support zone of the screen when the screen is moved from a low position, and close to the face opening, and the high position, such that, during this movement, the principal part of the screen pivots in a direction away from the face opening.

28. The safety helmet attachment arrangement of claim 27, wherein the support zone comprises a channel disposed on an inside of the screen, and wherein the projecting element is guidable into the channel.

29. The safety helmet attachment arrangement of claim 28, wherein the channel is positioned substantially at a junction between the principal portion and the at least one wing.

30. The safety helmet attachment arrangement of claim 28, wherein the cross-section of the channel forms an acute angle, and the projecting element comprises a point configured to interact with the acute angle of the channel.

31. A safety helmet, comprising:

an external shell having a face opening; and a screen;

wherein a principal part of the screen having at least one wing with at least one linkage piece mounted on the at least one wing, the at least one linkage piece comprising: a first arrangement for connecting the screen to the shell and configured to facilitate pivoting of the at least one linkage piece relative to the shell, such that the screen is moveable between a low position, in which the screen is substantially covering the face opening, and a high position, in which the face opening is substantially clear; and a second arrangement for connecting to the at least one wing and configured to facilitate the pivoting of the principal part relative to the at least one linkage piece; wherein the principal part is moveable relative to the at least one linkage piece between a position substantially away from and a position substantially close to the face opening when the screen is in the low position.

32. The safety helmet of claim 31, further comprising a ring configured to be attached to a portion of the external shell, wherein the screen is removably mounted on the ring, and wherein the principal part of the screen is located on the outside of the ring in a mounted position and when the screen is in a high position.

33. A safety helmet, comprising the arrangement according to claim 7.

* * * * *